US011342099B2

(12) United States Patent
Luo et al.

(10) Patent No.: US 11,342,099 B2
(45) Date of Patent: May 24, 2022

(54) LASER SHOCK PEENING METHOD FOR IMPROVING THE CORROSION RESISTANCE OF SINTERED ND—FE—B MAGNET

(71) Applicant: JIANGSU UNIVERSITY, Jiangsu (CN)

(72) Inventors: Kaiyu Luo, Jiangsu (CN); Changyu Wang, Jiangsu (CN); Fang Wang, Jiangsu (CN); Yefang Yin, Jiangsu (CN); Xiaohong Xu, Jiangsu (CN); Jinzhong Lu, Jiangsu (CN)

(73) Assignee: JIANGSU UNIVERSITY

( * ) Notice: Subject to any disclaimer, the term of this patent is extended or adjusted under 35 U.S.C. 154(b) by 0 days.

(21) Appl. No.: 16/492,574

(22) PCT Filed: Aug. 6, 2018

(86) PCT No.: PCT/CN2018/098901
§ 371 (c)(1),
(2) Date: Sep. 9, 2019

(87) PCT Pub. No.: WO2019/227664
PCT Pub. Date: Dec. 5, 2019

(65) Prior Publication Data

US 2021/0407711 A1 Dec. 30, 2021

(30) Foreign Application Priority Data

May 28, 2018 (CN) ..... 201810520763.7

(51) Int. Cl.
*H01F 1/057* (2006.01)
*C21D 10/00* (2006.01)
*H01F 41/02* (2006.01)

(52) U.S. Cl.
CPC ..... *H01F 1/0577* (2013.01); *C21D 10/005* (2013.01); *H01F 41/0253* (2013.01)

(58) Field of Classification Search
None
See application file for complete search history.

(56) References Cited

U.S. PATENT DOCUMENTS

2011/0233455 A1* 9/2011 Yan ..... H01F 41/0266 252/62.55

FOREIGN PATENT DOCUMENTS

CN 1056133 11/1991 ..... C25D 3/22
CN 1058053 1/1992 ..... C25D 3/12
(Continued)

OTHER PUBLICATIONS

International Search Report (w/ English translation) and Written Opinion issued in PCT/CN2018/098901, dated Feb. 11, 2019, 9 pages.

*Primary Examiner* — Xiaowei Su
(74) *Attorney, Agent, or Firm* — Hayes Soloway P.C.

(57) ABSTRACT

Disclosed is a surface modification technique for permanent magnetic materials. First, a sintered Nd—Fe—B magnet is immersed in a chlorine-containing solution to corrode its surface after the sintered Nd—Fe—B magnet is ground, polished and cleaned, so that atomic vacancies or gaps are produced at the grain boundaries in the surface layer of the corroded sintered Nd—Fe—B magnet; then, compound nanopowders coated on the surface of the sintered Nd—Fe—B magnet are implanted into the grain boundaries by laser shock peening to obtain a gradient nanostructure layer along the depth direction; at the same time, the surface nanocrystallization of the sintered Nd—Fe—B magnet and a residual compressive stress layer are induced by laser
(Continued)

Surface Corrosion Morphology of a Sintered Nd-Fe-B Magnet shock peening which remarkably improves the corrosion resistance of the sintered Nd—Fe—B magnet.

4 Claims, 4 Drawing Sheets

(56) References Cited

FOREIGN PATENT DOCUMENTS

| | | | |
|---|---|---|---|
| CN | 102560445 | 7/2012 | ..... C23C 18/18 |
| CN | 103646776 | 3/2014 | ..... C21D 1/09 |
| CN | 103668178 | 3/2014 | ..... B22F 1/00 |
| JP | S62290802 | 12/1987 | ..... B22F 3/24 |
| JP | S63147303 | 6/1988 | ..... B22F 3/24 |

* cited by examiner

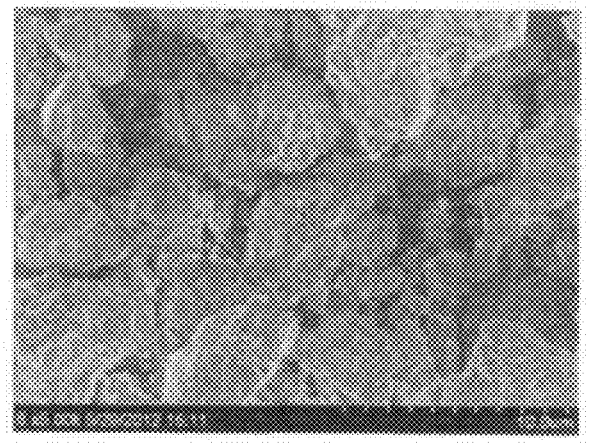
Fig. 1 - Surface Corrosion Morphology of a Sintered Nd-Fe-B Magnet

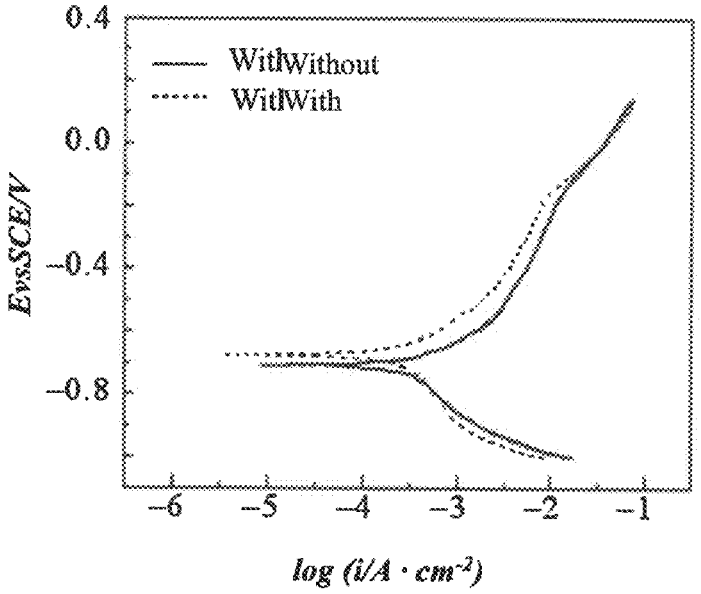
Fig. 2 - Polarization Curves of Sintered Nd-Fe-B Magnet $Nd_8Pr_4Fe_{81}Co_2B_{3.5}Cu_{1.5}$ with/without AlN Compound Nanopowders

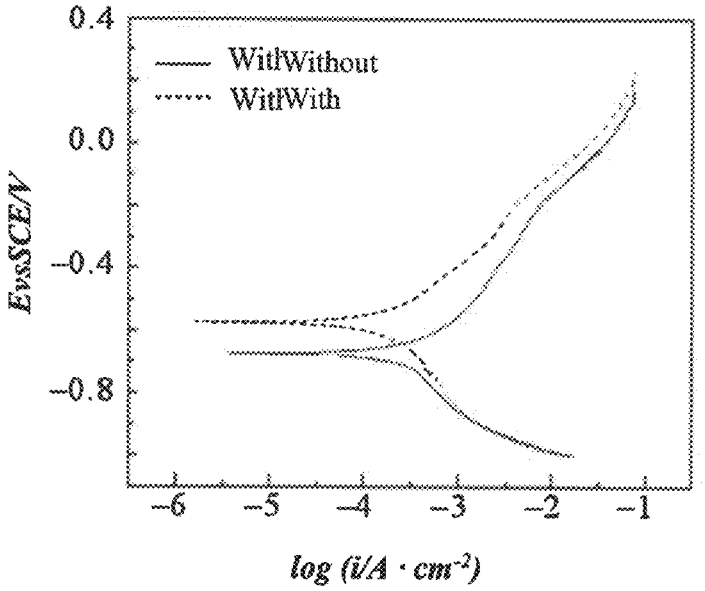
Fig. 3 - Polarization Curves of Sintered Nd-Fe-B Magnet $Nd_{10}Dy_2Fe_{79}B_8Al_{0.5}Mg_{0.5}$ with/without AlN Compound Nanopowders

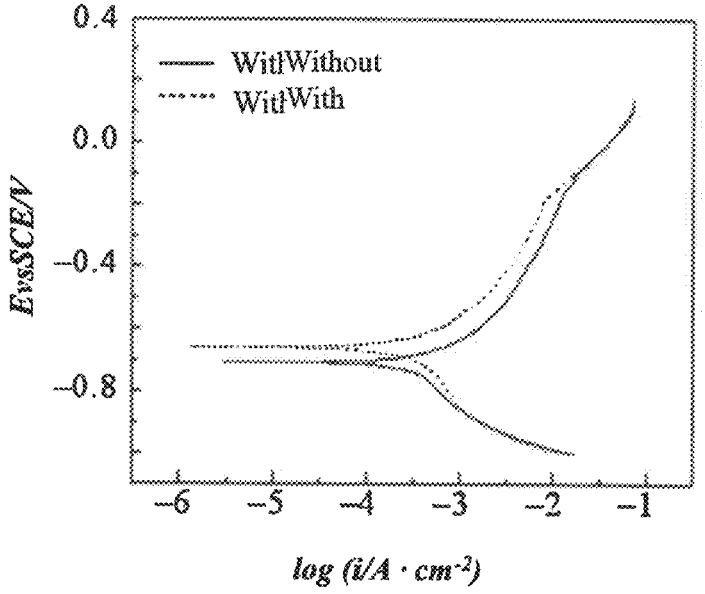
Fig. 4 - Polarization Curves of Sintered Nd-Fe-B Magnet $Nd_{15}Gd_{0.5}Fe_{80}B_4Ni_{0.5}$ with/without AlN Compound Nanopowders

LASER SHOCK PEENING METHOD FOR IMPROVING THE CORROSION RESISTANCE OF SINTERED ND—FE—B MAGNET

I. TECHNICAL FIELD

The present invention relates to the technical field of surface modification of permanent magnetic materials, particularly to a laser shock peening method for improving the corrosion resistance of a sintered Nd—Fe—B magnet.

II. BACKGROUND ART

Nd—Fe—B magnets are permanent magnets having the strongest magnetic force to date. As the third-generation rare earth permanent magnet materials, Nd—Fe—B magnets are widely applied in industries such as energy, transportation, machinery, medical, IT, and household appliances due to their excellent performance. Especially, with the development of the knowledge economy represented by information technology, demand for Nd—Fe—B rare earth permanent magnet industry and other functional materials is increasing, leading to broader market prospects for the Nd—Fe—B industry. However, in humid environments, intergranular corrosion may occur easily in the magnets owing to the existence of Nd-rich phases. Consequently, the corrosion resistance is degraded and the scope of the application of magnets is limited severely. A sintered Nd—Fe—B magnet mainly consists of an Nd—Fe—B principal phase and Nd-rich grain boundary phases, wherein the Nd-rich phases have high activity and low potential, and are easy to be corroded in environments with corrosive media, hot and humid environments, and the like. Since there are high potential differences between the Nd-rich phases and the Nd—Fe—B principal phase, sintered Nd—Fe—B magnets usually exhibit intergranular corrosion behaviors. The low corrosion resistance is a disadvantage of Nd—Fe—B magnets as well as one of the factors limiting their wide application. The corrosion of sintered Nd—Fe—B magnets not only destroys their integrity but also results in compromised magnetic properties, and seriously affects the actual application of magnets. Therefore, since sintered Nd—Fe—B magnets were successfully prepared for the first time in 1983, it has been of great practical significance to study the corrosion mechanism of sintered Nd—Fe—B magnets and improve the corrosion resistance of the magnets based on the corrosion mechanism of the magnets.

At present, the methods for surface protection of sintered Nd—Fe—B magnets mainly include electrogalvanizing, nickel electroplating and electrophoretic coating, etc. However, the surface protection of sintered Nd—Fe—B magnets is still one of the key problems limiting their application up to now due to the weak cohesion and insufficient corrosion resistance of coatings. Obtaining amorphous Ni—P alloys by means of chemical plating is a simple and feasible method, and good corrosion-resistant effects have been achieved as a corrosion-resistant protective coating of many corrosion-prone materials. However, sintered Nd—Fe—B magnet materials have rough and porous surfaces owing to the limitation of the material preparation process. Through numerous experiments, it is found that the traditional chemical plating process still can't fully meet the requirements for protection of magnets. Therefore, it is necessary to develop a new surface modification method for improving the corrosion resistance of sintered Nd—Fe—B magnets.

Laser shock peening (also referred to as laser shock processing) is a new surface strengthening technique. It utilizes the mechanical effect of shock waves induced by high-power laser to process materials, and has characteristics including high pressure, high energy, ultra-fast and ultra-high strain rate and so on. Besides, it causes plastic deformation in the surface layer of the treated material, changing the microstructure of the material in the surface layer, attaining an effect of grain refinement. At the same time, the depth of induced residual stress layer is up to 1~2 mm. Therefore, the strength, hardness, wear resistance and corrosion resistance properties of the treated material can be remarkably improved.

III. CONTENTS OF THE INVENTION

Based on the corrosion mechanism of sintered Nd—Fe—B magnets, the present invention provides a new surface modification method for improving the corrosion resistance of sintered Nd—Fe—B magnets. Firstly, a sintered Nd—Fe—B magnet is immersed in a chlorine-containing solution to corrode its surface after the Nd—Fe—B magnet is ground, polished and cleaned, so that atomic vacancies or gaps are produced at the grain boundaries in the surface layer of the corroded sintered Nd—Fe—B magnet. Then, compound nanopowders coated on the surface of the sintered Nd—Fe—B magnet are implanted into the grain boundaries by laser shock peening, i.e., under the mechanical effect of the ultra-strong shock wave induced by laser shock peening, the compound nanopowders are implanted into the surface layer of the sintered Nd—Fe—B magnet to obtain a gradient nanostructure layer along the depth direction. The technique can effectively implant compound nanopowders into the surface layer of a sintered Nd—Fe—B magnet under the mechanical effect of ultra-strong shock wave produced by laser shock peening, and thereby modify the compositions and structures of the grain boundary phases so as to improve the physicochemical properties of the grain boundary phases. At the same time, the surface nanocrystallization of the sintered Nd—Fe—B magnet and a compressive residual stress layer are induced by laser shock peening, and the corrosion resistance of the sintered Nd—Fe—B magnet is remarkably improved.

The specific steps are as follows:

(1) grinding and polishing the surface of a sintered Nd—Fe—B magnet, and then immersing the sintered Nd—Fe—B magnet in an alcoholic solution and removing the dust and oil stains from the surface of the sintered Nd—Fe—B magnet with an ultrasonic cleaner;

(2) immersing the sintered Nd—Fe—B magnet into a chlorine-containing solution to corrode its surface so that atomic vacancies or gaps are produced at the grain boundaries of the corroded sintered Nd—Fe—B magnet;

(3) taking out the pretreated sintered Nd—Fe—B magnet and drying it by cold air, and then mounting the sintered Nd—Fe—B magnet on a special fixture controlled by a manipulator;

(4) setting laser output power and laser spot parameters by means of a laser control device; specifically, a single-pulse Nd: YAG laser is used, and the working parameters are as follows: the wavelength is 1,064 nm, the pulse width is 8-16 ns, the energy per pulse is 5-7.6 J, and radius of the laser spot: 2-3 mm, the overlapping rate between two neighboring laser spots in both transverse and longitudinal directions is set to be 50%; at the same time, superposing the spot center of the laser beam on the top left corner of the magnet surface to be treated, and taking the position as an initial position of laser shock peening, and making the X-direction and Y-direction of the area to be treated in line with the X-direction and Y-direction of the loading platform;

(5) uniformly coating compound nanopowders on the corroded surface of the sintered Nd—Fe—B magnet sample, and turning on the laser at the same time; controlling the sintered Nd—Fe—B magnet sample with a manipulator to move to the focus of the laser beam; and carrying out laser shock peening on the corroded surface of the sintered Nd—Fe—B magnet; implanting the compound nanopowders into the surface layer of the sintered Nd—Fe—B magnet sample under the mechanical effect of the ultra-strong shock wave induced by laser shock peening; at the same time, inducing a residual compressive stress layer by laser shock peening so as to obtain a high-performance gradient nanostructure layer along the depth direction.

In the step (1), the atomic percentage of the sintered Nd—Fe—B magnet is $Nd_aR_bFe_{100-a-b-c-d}B_cM_d$, wherein, $8 \le a \le 18$, $0.5 \le b \le 5$, $3.5 \le c \le 8$, $0.1 \le d \le 5$, R is one or more of Pr, Dy, Tb, Ho, Gd, Ce, Co, Ni, Al, Cu, and Ga elements, and M is one or more of Al, Cu, Ga, Mg, Zn, Sn, Si, Co, Ni, Nb, Zr, Ti, W, and V elements.

In the step (2), the chlorine-containing solution is NaCl solution with a mass fraction of 3.5% or $MgCl_2$ solution with a mass fraction of 14%, and the immersion time is 30-120 minutes.

In the step (5), the compound nanopowder layer coated in the step (5) is in a thickness of 0.5-1 mm, and the average particle size of the compound nanopowders is 30-150 nm.

In the step (5), the compound nanopowder is AlN nanopowder with a high melting point, which belongs to covalent compounds, has an excellent thermal stability, and can stably exist in grain boundaries.

Technical effects of the present invention: in the present invention, first, a sintered Nd—Fe—B magnet is immersed in a chlorine-containing solution to corrode its surface after the Nd—Fe—B magnet is ground, polished and cleaned, so that atomic vacancies or gaps are produced at the grain boundaries in the surface layer of the corroded sintered Nd—Fe—B magnet. Then, compound nanopowders coated on the surface of the sintered Nd—Fe—B magnet are implanted into the grain boundaries by laser shock peening, i.e., under the mechanical effect of the ultra-strong shock waves produced by laser shock peening, the compound nanopowders are implanted into the surface layer of the sintered Nd—Fe—B magnet to obtain a gradient nanostructure layer along the depth direction, modify the compositions and structures of the grain boundary phases so as to improve the physicochemical properties of the grain boundary phases; at the same time, the surface nanocrystallization of the sintered Nd—Fe—B magnet and a residual compressive stress layer are induced by laser shock peening, and thereby the corrosion resistance of the sintered Nd—Fe—B magnet is improved remarkably.

IV. DESCRIPTION OF DRAWINGS

FIG. 1 shows the surface corrosion morphology of a sintered Nd—Fe—B magnet;

FIG. 2 is a schematic diagram illustrating the comparison between the potentiodynamic polarization curve of a sintered Nd—Fe—B magnet $Nd_8Pr_4Fe_{81}Co_2B_{3.5}Cu_{1.5}$ with AlN nanometer powder and the potentiodynamic polarization curve of a sintered Nd—Fe—B magnet $Nd_8Pr_4Fe_{81}Co_2B_{3.5}Cu_{4.5}$ without AlN nanometer powder in NaCl solution with a mass fraction of 14%;

FIG. 3 is a schematic diagram illustrating the comparison between the potentiodynamic polarization curve of a sintered Nd—Fe—B magnet $Nd_{10}Dy_2Fe_{79}B_8Al_{0.5}Mg_{0.5}$ with AlN nanometer powder and the potentiodynamic polarization curve of a sintered Nd—Fe—B magnet $Nd_{10}Dy_2Fe_{79}B_8Al_{0.5}Mg_{0.5}$ without AlN nanometer powder in NaCl solution with a mass fraction of 3.5%;

FIG. 4 is a schematic diagram illustrating the comparison between the potentiodynamic polarization curve of a sintered Nd—Fe—B magnet $Nd_{15}Gd_{0.5}Fe_{80}B_4Ni_{0.5}$ with AlN nanometer powder and the potentiodynamic polarization curve of a sintered Nd—Fe—B magnet $Nd_{15}Gd_{0.5}Fe_{80}B_4Ni_{0.5}$ without AlN nanometer powder in NaCl solution with a mass fraction of 3.5%.

V. EMBODIMENTS

Hereunder the technical scheme of the present invention will be further detailed in some embodiments with reference to the accompanying drawings.

In the following examples using the above-mentioned strengthening method to process sintered Nd—Fe—B magnets, the steps include:

Embodiment 1

(1) The surface of a sintered Nd—Fe—B magnet $Nd_8Pr_4Fe_{81}Co_2B_{3.5}Cu_{1.5}$ is ground and polished with 500 #-2400 #SiC abrasive paper, and then the sintered Nd—Fe—B magnet is immersed in an alcoholic solution to remove the dust and oil stains from the surface of the sintered Nd—Fe—B magnet with an ultrasonic cleaner;

(2) The sintered Nd—Fe—B magnet is immersed into NaCl solution with a mass fraction of 14% and held for 30 minutes so that atomic vacancies or gaps are produced at the grain boundaries when the surface of the sintered Nd—Fe—B magnet is corroded;

(3) The pretreated sintered Nd—Fe—B magnet is taken out and dried by cold air, and then the sintered Nd—Fe—B magnet is mounted on a special fixture controlled by a manipulator;

(4) The laser output power and laser spot parameters are set by means of a laser control device; specifically, a single-pulse Nd:YAG laser is used, and the working parameters are as follows: the wavelength is 1,064 nm, the pulse width is 16 ns, the energy per pulse is 5.6 J, the radius of the laser spot is 3 mm, and the overlapping rate between two neighboring laser spots in both transverse and longitudinal directions is set to be 50%; at the same time, the spot center of the laser beam is superposed on the top left corner of the magnet surface to be treated and the position is taken as an initial position of laser shock peening, and the X-direction and Y-direction of the area to be treated is kept in line with the X-direction and Y-direction of the loading platform;

(5) AlN compound nanopowders with an average particle size of 50 nm are uniformly coated on the surface of the sintered Nd—Fe—B magnet sample, wherein, the thickness of the coating is 0.5 mm; after turning on the laser, the sintered Nd—Fe—B magnet sample is controlled with a manipulator to move to the focus of the laser beam, and massive laser shock peening is carried out on the surface of the magnet using a line-by-line processing method; the AlN compound nanopowders are implanted into the surface layer of the sintered Nd—Fe—B magnet under the mechanical effect of the ultra-strong shock wave produced by laser shock peening, and a residual compressive stress layer is induced by laser shock peening at the same time so as to obtain a high-performance gradient nanostructure layer along the depth direction.

In this embodiment, an electrochemical corrosion test is carried out for the sintered Nd—Fe—B magnet $Nd_8Tb_3Fe_{83}Co_2B_{3.5}Cu_{1.5}$, and the test result is compared with that of the sintered Nd—Fe—B magnet before treatment. It is seen from FIG. 2: after adding the AlN compound nanopowders, the corrosion potential of the sample increases, and the corrosion current density decreases. The test result indicates: adding AlN nanometer powders at the grain boundaries decreases the quantity of Nd-rich phases in the grain boundary area, the corrosion potential of the grain boundary phases increases, and the stability of the grain boundaries is improved. According to the mechanism of electrode reaction, the increase of potential of the grain boundary phases leads to the increase of corrosion potential of the entire sintered Nd—Fe—B magnet. The result further demonstrates that adding AlN nanometer powder at the grain boundaries can remarkably improve the corrosion resistance of the sintered Nd—Fe—B magnet $Nd_8Pr_4Fe_{83}Co_2B_{3.5}Cu_{1.5}$.

Embodiment 2

(1) The surface of a sintered Nd—Fe—B magnet $Nd_{10}Dy_2Fe_{79}B_8Al_{0.5}Mg_{0.5}$ is ground and polished with 500 #-2400 #SiC abrasive paper, and then the sintered Nd—Fe—B magnet is immersed in an alcoholic solution to remove the dust and oil stains from the surface of the sintered Nd—Fe—B magnet with an ultrasonic cleaner;

(2) The sintered Nd—Fe—B magnet is immersed into NaCl solution with a mass fraction of 3.5% and held for 60 minutes so that atomic vacancies or gaps are produced at the grain boundaries when the surface of the sintered Nd—Fe—B magnet is corroded;

(3) The pretreated sintered Nd—Fe—B magnet is taken out and dried by cold air, and then the sintered Nd—Fe—B magnet is mounted on a special fixture controlled by a manipulator, (4) The laser output power and laser spot parameters are set by means of a laser control device; specifically, a single-pulse Nd:YAG laser is used, and the working parameters are as follows: the wavelength is 1,064 nm, the pulse width is 8 ns, the energy per pulse is 7.6 J, the radius of the light spot is 3 mm, and the overlapping rate between two neighboring laser spots in both transverse and longitudinal directions is set to be 50%; at the same time, the spot center of the laser beam is superposed on the top left corner of the magnet surface to be treated and the position is taken as an initial position of laser shock peening, and the X-direction and Y-direction of the area to be treated is kept in line with the X-direction and Y-direction of the loading platform;

(5) AlN compound nanopowders with an average particle size of 150 nm are uniformly coated on the surface of the sintered Nd—Fe—B magnet sample, wherein, the thickness of the coating is 1 mm; after turning on the laser, the sintered Nd—Fe—B magnet sample is controlled with a manipulator to move to the focus of the laser beam, and massive laser shock peening is carried out on the surface of the magnet using a line-by-line processing method; the AlN compound nanopowders are implanted into the surface layer of the sintered Nd—Fe—B magnet under the mechanical effect of the ultra-strong shock wave produced by laser shock peening, and a residual compressive stress layer is induced by laser shock peening at the same time so as to obtain a high-performance gradient nanostructure layer along the depth direction.

In this embodiment, an electrochemical corrosion test is carried out for the sintered Nd—Fe—B magnet $Nd_8Pr_4Fe_{83}Co_2B_{3.5}Cu_{1.5}$, and the test result is compared with that of the sintered Nd—Fe—B magnet before treatment. Likewise, it is seen from FIG. 3: after adding the AlN compound nanopowders, the corrosion potential of the sample increases, and the corrosion current density decreases.

Embodiment 3

(1) The surface of a sintered Nd—Fe—B magnet $Nd_{15}Gd_{0.5}Fe_{80}B_4Ni_{0.5}$ is ground and polished with 500 #-2400 #SiC abrasive paper, and then the sintered Nd—Fe—B magnet is immersed in an alcoholic solution to remove the dust and oil stains from the surface of the sintered Nd—Fe—B magnet with an ultrasonic cleaner;

(2) The sintered Nd—Fe—B magnet is immersed into NaCl solution with a mass fraction of 3.5% and held for 90 minutes so that atomic vacancies or gaps are produced at the grain boundaries when the surface of the sintered Nd—Fe—B magnet is corroded;

(3) The pretreated sintered Nd—Fe—B magnet is taken out and dried by cold air, and then the sintered Nd—Fe—B magnet is mounted on a special fixture controlled by a manipulator;

(4) The laser output power and laser spot parameters are set by means of a laser control device; specifically, a single-pulse Nd:YAG laser is used, and the working parameters are as follows: the wavelength is 1,064 un, the pulse width is 10 ns, the energy per pulse is 6 J, the radius of the laser spot is 3 mm, and the overlapping rate between two neighboring laser spots in both transverse and longitudinal directions is set to be 50%; at the same time, the spot center of the laser beam is superposed on the top left corner of the magnet surface to be treated and the position is taken as an initial position of laser shock peening, and the X-direction and Y-direction of the area to be treated is kept in line with the X-direction and Y-direction of the loading platform;

(5) AlN compound nanopowders with an average particle size of 100 nm are uniformly coated on the surface of the sintered Nd—Fe—B magnet sample, wherein, the thickness of the coating is 0.7 mm; after turning on the laser, the sintered Nd—Fe—B magnet sample is controlled with a manipulator to move to the focus of the laser beam, and massive laser shock peening is carried out on the surface of the magnet using a line-by-line processing method, the AlN compound nanopowders are implanted into the surface layer of the sintered Nd—Fe—B magnet under the mechanical effect of the super strong shock wave produced by laser shock peening, and a residual compressive stress layer is induced by laser shock peening at the same time so as to obtain a high-performance gradient nanostructure layer along the depth direction.

In this embodiment, an electrochemical corrosion test is carried out for the sintered Nd—Fe—B magnet $Nd_8Pr_4Fe_{83}Co_2B_{3.5}Cu_{1.5}$, and the test result is compared with that of the sintered Nd—Fe—B magnet before treatment. Likewise, it is seen from FIG. 4: after adding the AlN compound nanopowders, the corrosion potential of the sample increases, and the corrosion current density decreases.

The invention claimed is:

1. A laser shock peening method for forming a sintered Nd—Fe—B magnet, wherein: first, a sintered Nd—Fe—B magnet is immersed in a chlorine-containing solution to corrode its surface after the sintered Nd—Fe—B magnet is ground, polished and cleaned, so that atomic vacancies or gaps are produced at the original grain boundaries of the corroded sintered Nd—Fe—B magnet; then, compound nanopowders coated on the surface of the sintered Nd—Fe—B magnet are implanted into the grain boundaries by laser shock peening, to form a gradient nanostructure layer along the depth direction; at the same time, the surface nanocrystallization of the sintered Nd—Fe—B magnet and a residual compressive stress layer are induced by laser shock peening; whereupon the compositions and structures of the grain boundary phases, and the physicochemical properties of the grain boundary phases are modified, and an effect of inhibiting grain boundary corrosion in the surface of the magnet is achieved, wherein, the chlorine-containing solution is NaCl solution with a mass fraction of 3.5% or $MgCl_2$ solution with a mass fraction of 14%, and the immersion time is 30-120 minutes;

the compound nanopowder is AlN nanometer powder, which belongs to covalent compounds, and can exist in grain boundaries;

the atomic percentage of the sintered Nd—Fe—B magnet is $Nd_aR_bFe_{100-a-b-c-d}B_cM_d$, wherein, $8 \leq a \leq 18$, $0.5 \leq b \leq 5$, $3.5 \leq c \leq 8$, $0.1 \leq d \leq 5$, R is one or more of Pr, Dy, Tb, Ho, Gd, Ce, Co, Ni, Al, Cu, and Ga elements, and M is one or more of Al, Cu, Ga, Mg, Zn, Sn, Si, Co, Ni, Nb, Zr, Ti, W, and V elements;

the laser is a single-pulse Nd:YAG laser, and the working parameters are as follows: the wavelength is 1,064 nm, the pulse width is 8-16 ns, the energy per pulse is 5-7.6 J, and the laser spot radius is 2-3 mm.

2. The laser shock peening method for forming a sintered Nd—Fe—B magnet according to claim 1 comprising the steps of:

(1) grinding and polishing the surface of a sintered Nd—Fe—B magnet, and then immersing the sintered Nd—Fe—B magnet in an alcoholic solution and removing the dust and oil stains from the surface of the sintered Nd—Fe—B magnet with an ultrasonic cleaner;

(2) immersing the sintered Nd—Fe—B magnet into a chlorine-containing solution to corrode its surface so that atomic vacancies or gaps are produced at the grain boundaries of the corroded sintered Nd—Fe—B magnet;

(3) removing the pretreated sintered Nd—Fe—B magnet from the chlorine-containing solution and drying it in air, and then mounting the sintered Nd—Fe—B magnet on a fixture controlled by a manipulator;

(4) setting laser output power and laser spot parameters by a laser control device; at the same time, superposing the spot center of the laser beam on the top left corner of the magnet surface to be treated and taking the position as an initial position of laser shock peening, and making the X-direction and Y-direction of the area to be treated in line with the X-direction and Y-direction of the loading platform;

(5) coating compound nanopowders on the surface of the sintered Nd—Fe—B magnet sample, and turning on the laser at the same time; controlling the sintered Nd—Fe—B magnet sample with a manipulator to move to the focus of the laser beam, and carrying out laser shock peening on the corroded surface of the sintered Nd—Fe—B magnet using a line-by-line processing method; implanting the compound nanopowders into the surface layer of the sintered Nd—Fe—B magnet sample under the mechanical effect of a shock wave produced by laser shock peening; and inducing a residual compressive stress layer by laser shock peening so as to obtain a gradient nanostructure layer along the depth direction.

3. The laser shock peening method for forming a sintered Nd—Fe—B magnet according to claim 2, wherein, in step (4), the overlapping rate between two neighboring laser spots in both transverse and longitudinal directions is set to be 50%.

4. The laser shock peening method for forming a sintered Nd—Fe—B magnet according to claim 2, wherein, in the step (5), the thickness of the compound nanopowder layer coated in step (5) is 0.5-1 mm, and the average particle size of the compound nanopowders is 30-150 nm.

* * * * *